United States Patent [19]

Hopf

[11] 4,095,858

[45] Jun. 20, 1978

[54] BOOK CASE APPARATUS

[76] Inventor: John L. Hopf, 3322 Blaisdell Ave., #201, Minneapolis, Minn. 55408

[21] Appl. No.: 764,834

[22] Filed: Feb. 2, 1977

[51] Int. Cl.[2] ..... A47B 53/00

[52] U.S. Cl. ..... 312/198; 52/608; 211/194; 312/111

[58] Field of Search ..... 211/42, 194; 52/608; 312/108, 111, 198

[56] References Cited

U.S. PATENT DOCUMENTS

| | | | |
|---|---|---|---|
| 3,713,717 | 1/1973 | Hafner | 312/198 |
| 3,790,241 | 2/1974 | Messina | 312/111 |
| 4,008,932 | 2/1977 | Wildschut | 312/198 |
| 4,023,681 | 5/1977 | Plant | 312/198 |

FOREIGN PATENT DOCUMENTS

| | | | |
|---|---|---|---|
| 1,511,125 | 7/1969 | Germany | 211/194 |
| 2,032,572 | 1/1972 | Germany | 211/194 |

*Primary Examiner*—Casmir A. Nunberg

*Attorney, Agent, or Firm*—Dugger, Johnson & Westman

[57] ABSTRACT

A plurality of modules that are generally P-shaped and are of the same size and shape which may be arranged in different stacked relationships to form book cases or the like. As to each module, the closed loop of the P is of a generally rectangular box-shape construction while the leg of the P extends outwardly of the closed loop coextensive and coplanar with one side of the closed loop. The modules are stacked so that the walls thereof are inclined. Optionally shelves may be mounted by the closed loops.

6 Claims, 3 Drawing Figures

BOOK CASE APPARATUS

BACKGROUND OF THE INVENTION

A plural of modules that may be arranged in various selected relationships to provide a bookcase or the like.

In the prior art it is old to use modules of different shapes including a shape described as "6's" for making furniture, see U.S. Pat. No. 3,713,717. Further, it is old to provide a plurality of identical modules for constructing cabinets and the like, for example, see U.S. Pat. Nos. 3,257,154 and 3,567,302. However, such prior art modules are not readily stackable to provide book cases or the like of designs that have shelves inclined at upward angles to retain books and provide access thereto at one side of the stacked modules.

SUMMARY OF THE INVENTION

A plurality of identical modules that are stackable to form a book case or the like and that are generally of a P-shape. Advantageously, the modules are stacked such that the long side of the P extends at an inclined angle to the horizontal.

One of the objects of this invention is to provide a plurality of identical modules of a new and novel shape for stacking to provide a book case or the like. Another object of this invention is to provide a book case or the like made up of a plurality of identical modules that are stackable in new and novel configurations. A still further object of this invention is to provide book cases of new and novel configurations that are constructed from identical modules.

BRIEF DESCRIPTION OF THE DRAWINGS

Referring to FIG. 1, the book case illustrated therein is made up of a plurality of identical modules that are respectfully generally designated 10 through 15. Each module is generally of a "P" shape and includes a longitudinally elongated wall 20; a wall 21 that is of a shorter length than wall 20 and that is parallel thereto; a transverse wall 22 that extends between the one end of walls 20, 21 and is joined thereto to be in perpendicular relationship to walls 20, 21; and a wall 23 that is parallel to wall 23, extends between the other end of wall 21 and the mid-portion of wall 20, and is joined thereto. Thus the closed loop portion of the P is formed by walls 21, 22, 23 and portion **20*a* of wall 20 and is of a rectangular box shape that is open at both the front and rear. Wall 20 includes a leg portion 20*b* that is integrally joined to portion 20*a* to extend coplanar therewith and outwardly of the closed looped portion of the P. Preferrably each of the walls is of the same thickness W while the length of wall 21 is of a dimension Z; the transverse length of each of the walls 22, 23 is of a dimension Y minus W, and the longitudinal length of wall 20** is X minus W. Also, preferrably dimensions Y and Z are equal, and each is equal to ½X. The walls are preferrable of the same width R which may be of any suitable width.

Figure 1:
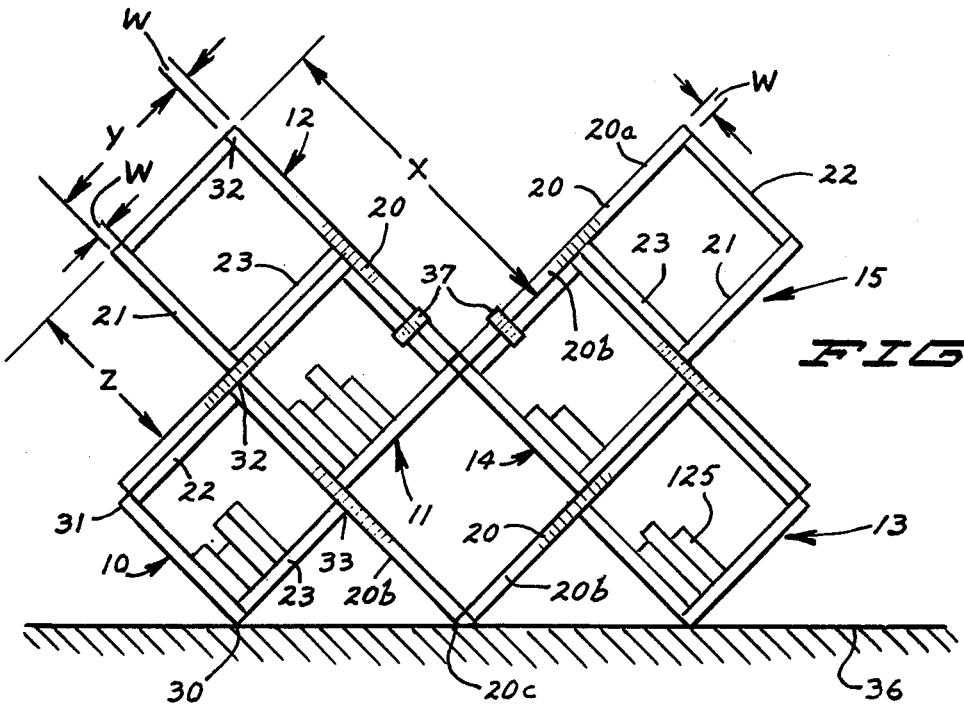
FIG. 1 is a front view of a plurality of modules of this invention stacked to form a book case or the like of one configuration.
Figure 2:
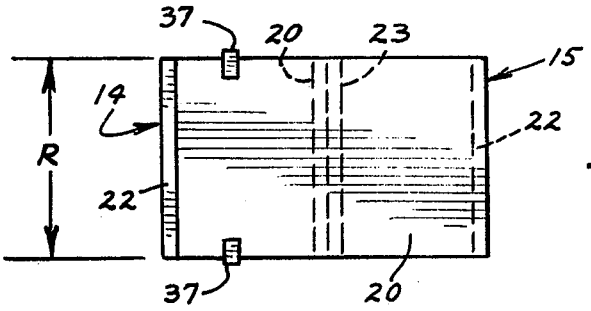
FIG. 2 is a side view showing the leg of one of the modules of this invention clipped to the closed looped portion of another module of this invention.

For purposes of further describing the invention each module has an exterior corner portion 30 adjacent the juncture of walls 21, 23; an exterior corner portion 31 adjacent the juncture of walls 21, 22; an exterior corner portion 32 adjacent the juncture of walls 22, 20 and a shoulder portion 33 at the juncture of wall portion **20*b* and wall 23; while the leg 20*b* has an end portion 20*c* that is remote from wall portion 20*a* and walls 22, 23**.

One stacked arrangement of modules of this invention is shown in FIG. 1 wherein modules 10 and 13 are positioned on the supporting surface (floor) 36 with their end portions **20*c* and corners 30 abutting against the floor and end portions 20*c* abutting. As a result walls 20 of modules 10, 13 diverge in an upward direction. Module 11 is placed on module 10 such that corner portion 32 of module 10 abuts against shoulder 33 of module 11 and leg 20*b* of module 11 overlays wall 22 of module 10; while module 14 is placed on module 13 such that corner portion 32 of module 13 abuts against shoulder 33 of module 14 and leg 20*b* of module 14 abuts against wall 22 of module 13. As a result walls 20 of modules 11 and 14 converge in an upward direction and the corner portions 31 of said modules are very closely to be in abutting relationship and preferrably are in abutting relationship. Module 12 is positioned on module 11 such that its shoulder 33 abuts against corner 32 of module 11 and its leg 20*b* abuts against wall 22 of module 11, while module 15 is positioned on module 14 such that its shoulder 33 abuts against corner 32 of module 14 and its leg 20*b* abuts against wall 22 of module 11. As a result the walls 20 of modules 12, 15 diverge in an upwardly direction and have their end portions 20*c* are closely adjacent one another and preferrably in abutting relationship. If desired, additional modules can be positioned on modules 12 and 15 and that their legs 20 alternately converge and diverge such as indicated for the modules therebeneath. The uppermost modules, 12 and 15, as per the embodiment of FIG. 1, may be secured to the modules therebeneath by, for example, generally U-shaped spring clips 37 that have their legs abutting against the legs 20*b* of the uppermost modules and the walls 22 of the next lowermost modules 11 and 14. Usually clips will only be needed if the walls 20 of the uppermost modules (12, 15) diverge, and the walls 21** do not have the longitudinal elongated surfaces thereof abutting against longitudinally elongated surfaces of other modules.

With reference to FIG. 1, it is to be mentioned that a book case can be formed using only, for example, modules 13, 14 and 15 stacked as illustrated, or by using only modules 13, 14 in the stacked relationship shown.

In the arrangement of FIG. 1, the walls 20 of modules 10 12 and 14 are parallel to one another, while the walls 20 of modules 11, 13 and 15 are parallel to one another.

Figure 3:
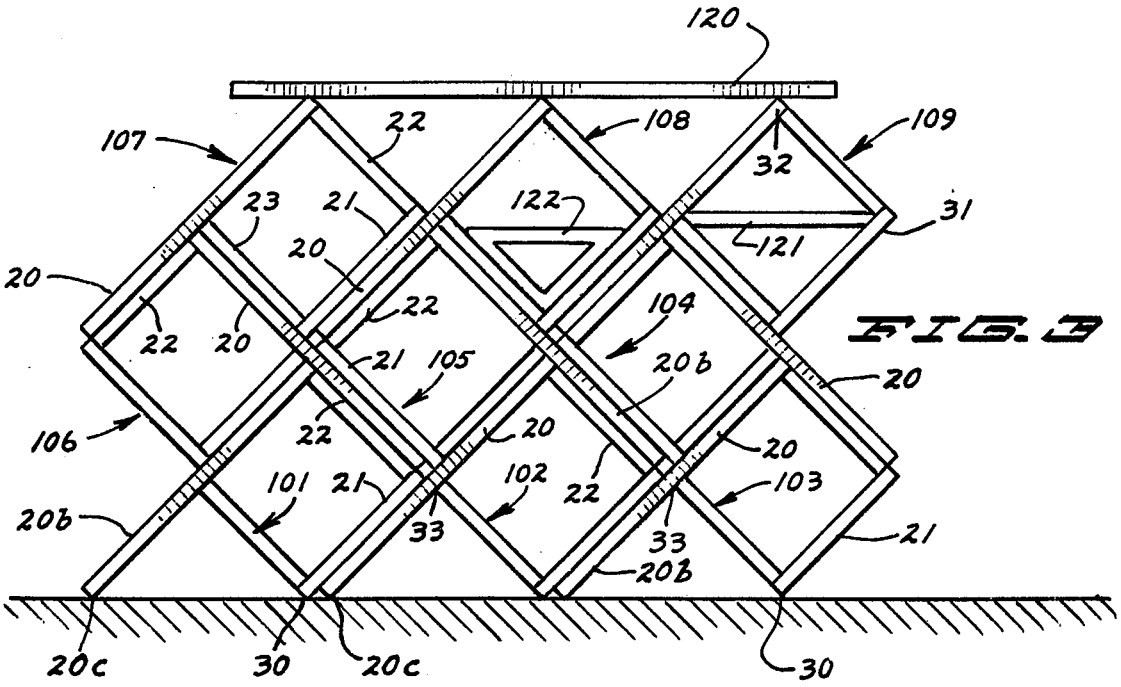
FIG. 3 is a view similar to that of FIG. 1 other than it shows a different stacked arrangement of the modules and level shelves that optionally may be used.

Referring to FIG. 3, a different stacked arrangement of modules of this invention is shown. Each of the modules of FIG. 3 is identical to that of the modules FIG. 1, but have been generally designated 101 through 109 to facilitate the description of the stacking thereof. Modules 101, 102 and 103 are placed on the floor 36 with their end portions **20*c* and corners 30 abutting thereagainst, wall 21 of module 101 abutting against leg 20*b* of module 102, and wall 21 of module 102 abutting against leg 20*b* of module 103. Thus walls 20 of modules 101–103** are parallel to one another and are inclined at a substantial angle relative to the vertical and to the floor.

Modules 104, 105 and 106 are positioned such that their walls 23 abut against wall portions **20*a*** of modules 103, 102 and 101 respectively; and their legs 20*b* abut against walls 22 of modules 103, 102 and 101 respectively. Further, leg 20*b* of module 106 extends between wall 22 of module 101 and wall 21 of module 105 in abutting relationship with said wall 21. Likewise leg 20*b* of module 105 extends between wall 22 of module 102 and wall 21 of module 104 and in abutting relationship with wall 21 of module 104. Thus corners 32 of modules 101, 102 and 103 abut against shoulders 33 of modules 106, 105 and 104 respectively. Further, walls 20 of modules 104, 105 and 106 are parallel to one another, and are inclined upwardly to be perpendicular to walls 20 of modules 101, 102 and 103 respectively.

Modules 107, 108 and 109 are positioned such that their walls 23 abut against wall portions 20*a* of modules 106, 105 and 104 respectively; and their legs 20*b* abut against walls 22 of modules 106, 105 and 104 respectively. Further, leg 20*b* of module 109 extends between wall 22 of module 104 and wall 21 of module 108 in abutting relationship with said wall 21. Likewise leg 20*b* of module 108 extends between wall 22 of module 105 and wall 21 of module 107 and in abutting relationship with wall 21 of module 107. Thus corners 32 of modules 104, 105 and 106 abut against shoulders 33 of modules 109, 108 and 107 respectively. Further walls 20 of modules 107, 108 and 107 are parallel to one another, and are inclined upwardly to be perpendicular to walls 20 of modules 104, 105 and 106 respectively, and also parallel to walls 20 of modules 101, 102 and 103. Additional rows of modules can be stacked on the row 107, 108, 109 with the next higher row having its wall 20 abutting against walls 22 of row 107, 108, 109 and perpendicular to the walls 20 thereof, and the next higher row having its walls 20 inclined opposite to the walls 20 of the row therebeneath.

In the event modules of FIG. 3 tend to or do slip or turn out of the stacked relationship, such modules can be clipped to adjacent modules by using clips such as clips 37.

It is believed apparent that the book case of FIG. 3 can be made of a greater length by, for example, three modules can be stacked to have the same relationship to modules 103, 104, 109, that modules 103, 104, 109 have to modules 102, 104, 108, alternately three modules can be stacked to have the same relationship to modules 101, 106, 107 that modules 10, 11, 12 have modules 13, 14, 15.

If desired a tabletop 120 can be placed on modules 107, 108, 109 to be supported by the corners 32 thereof. Additionally, a horizontal shelf 121 can be mounted by a module such as indicated in FIG. 3. Further a right triangular member 122 can be mounted by the closed loop part of a module whereby the longest leg thereof provides a horizontal shelf.

As indicated in FIG. 1 for some of the modules, books 125 may be stored in the closed loop parts of the modules.

With the dimensions X, Y and W being of the relative lengths previously indicated the walls 20 extend upwardly at an angle of about 45° to the horizontal. As an example of one embodiment of the invention, but not otherwise as a limitation thereon, the dimension R is 8 inch, W is 1 inch, Z is 12 inch, Y is 12 inch and X is 24 inch whereby the length of wall 20 is 23 inch. With the above dimensions the walls 20 extend at angles of about 45° to the horizontal.

To be mentioned is that the modules may each be of an integral one piece construction instead of made up of four pieces as described herein.

Also to be noted is that the opposite surfaces of each of the walls of the modules are generally planar and parallel to one another, and that no structure is joined to the walls to protrude outwardly of their planar surfaces to prevent the modules being stacked in the relationship described herein.

What is claimed is:

1. A book case or the like on a supporting surface comprising a plurality of identical, generally P-shaped modules, each module including an elongated first wall, a second wall, a third wall and a fourth wall, each of the second, third and fourth walls being of a substantially shorter length than the first wall, the first end portions of the second and third walls being joined to the first wall in spaced relationship to one another, the first and second end portions of the fourth wall being joined the second end portions of the second wall and third wall respectively, the first end portion of the third wall being joined to the first wall about midway the first wall first and second end portions, the first wall second end portion having a terminal end, the first wall first end portion being joined to the second wall first end portion, and the first and fourth walls being parallel to one another and perpendicular to the second and third walls, said plurality of modules including a first module and a second module having their first walls parallel to one another and inclined at substantial angles to both the horizontal and vertical, the fourth wall of the second module abutting against the first wall of the first module, the terminal ends abutting against the supporting surface and the corner portion defined by the juncture of the third and fourth walls of each the first and second modules abutting against the supporting surface.

2. A book case or the like comprising a plurality of identical generally P-shaped modules, each module being in abutting relationship with an adjacent module, and each of said modules including a first wall, a second wall, a third wall and a fourth wall, each of said walls being elongated and having a first end portion and a second end portion, each of the second, third and fourth walls being of a substantially shorter length than the first wall, the first end portions of the second and third walls being joined to the first wall in spaced relationship to one another, the first and second end portions of the fourth wall being joined to the second end portions of the second wall and third wall respectively, the first end portion of the third wall being joined to the first wall about midway between the first wall first and second end portions, the second and third walls being parallel to one another and perpendicular to the first wall, the fourth wall being parallel to the first wall, the first wall second end portion having a terminal end surface, the minimum spacing between the first and fourth walls being greater than the minimum spacing of the two and third walls by a dimension that is substantially equal to the thickness of one of said walls, the first and second wall first end portions being joined to one another, the minimum spacing of the third wall from the terminal end surface being greater than the minimum spacing of the fourth wall from the first wall by a dimension that is substantially equal to the thickness of one of said walls, and the walls being of substantially the same thickness.

3. A book case or the like comprising a plurality of identical generally P-shaped modules, each module being in abutting relationship with an adjacent module, and each of said modules including a first wall, a second wall, a third wall and a fourth wall, each of said walls being elongated and having a first end portion and a second end portion, each of the second, third and fourth walls being of a substantially shorter length than the first wall, the first end portions of the second and third walls being joined to the first wall in spaced relationship to one another, the first and second end portions of the fourth wall being joined to the second end portions of the second wall and third wall respectively, said plurality of modules including a first module, a second module and a third module, the first wall of the first module being in abutting relationship with the second wall of the second module, the third module first wall being in abutting relationship to the first module second wall, the second and third modules first walls being parallel to one another, the first module first wall being perpendicular to the second module first wall, the first module extending to a higher elevation than the second module and the third module extending to a higher elevation than the first module.

4. The apparatus of claim 1 further characterized in that said plurality of modules includes a third module extending to a higher elevation than the first and second modules, the third module having its first wall abutting against the second wall of the first module and extending perpendicular to the first wall of first module, and its third wall abutting against the first wall of the first module.

5. The apparatus of claim 4 further characterized in that said plurality of modules includes a fourth module extending to a higher elevation than the first and second modules, the fourth module having its first wall abutting against the second wall of the second module and the fourth wall of the third module, and extending perpendicular to the first wall of second module, and its third wall abutting against the first wall of the second module.

6. A book case or the like on a supporting surface comprising a plurality of identical, generally P-shaped modules, each module including an elongated first wall, a second wall, a third wall and a fourth wall, each of said walls having a first end portion and a second end portion, each of the second, third and fourth walls being of a substantially shorter length than the first wall, the first end portions of the second and third walls being joined to the first wall in spaced relationship to one another, and the first and second end portions of the fourth wall being joined the second end portions of the second wall and third wall respectively, the first end portion of the third wall being joined to the first wall about midway the first wall first and second end portions, the first wall second end portion having a terminal end, the first wall first end portion being joined to the second wall first end portion, and the first and fourth walls being parallel to one another and perpendicular to the second and third walls, said plurality of modules including a first module and a second module having their first walls perpendicular to one another and inclined at substantial angles to both the horizontal and vertical, the third wall of the second module abutting against first wall of the first module, the second wall of the first module abutting against the first wall of the second module, the second module extending to a substantially higher elevation than the first module.

* * * * *